US006758699B1

(12) United States Patent
Hwang et al.

(10) Patent No.: US 6,758,699 B1
(45) Date of Patent: Jul. 6, 2004

(54) RJ CONNECTOR WITH ROBUST CONNECTOR ASSEMBLY FOR TRANSCEIVER MODULE

(75) Inventors: Jenq-Yih Hwang, Irvine, CA (US); Wayne Huang, Alhambra, CA (US); Eddy Wong, Irvine, CA (US); Hung Tieu, Alhambra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/434,944

(22) Filed: May 8, 2003

(51) Int. Cl.[7] ..... H01R 24/00
(52) U.S. Cl. ..... 439/676
(58) Field of Search ..... 439/676, 607, 439/76.1

(56) References Cited

U.S. PATENT DOCUMENTS 5,169,346 A * 12/1992 Johnston ..... 439/676
6,296,527 B1 * 10/2001 Zhang et al. ..... 439/676
6,430,053 B1 8/2002 Peterson et al.

* cited by examiner

*Primary Examiner*—Ross Gushi
(74) *Attorney, Agent, or Firm*—Wei Te Chung

(57) ABSTRACT

A small form factor pluggable transceiver module (100) comprises an RJ connector (1) with a robust interface, a printed circuit board assembly (2), a cage (4), a frame (5) and a latch mechanism (6). The RJ connector further includes a shielding shell (11), a housing (12) received in the shielding shell, an RJ contact module (13) received in the housing, and an engaging clamp (3). The RJ connector attaches to the printed circuit board assembly. The engaging clamp provides a stronger, more reliable mechanical connection between the printed circuit board assembly and the RJ connector.

21 Claims, 7 Drawing Sheets

RJ CONNECTOR WITH ROBUST CONNECTOR ASSEMBLY FOR TRANSCEIVER MODULE

BACKGROUND OF THE INVENTION

1. Field of the Invention

This invention relates generally to a small form factor pluggable (SFP) transceiver module, and more particularly to an RJ connector with a robust connector assembly for use in an SFP transceiver module. The application relates to a contemporaneously filed application titled "RJ CONNECTOR FOR TRANSCEIVER MODULE" and having the same applicants and the same assignee as the instant invention.

2. Description of the Related Art

Transceivers are utilized to interconnect circuit cards of communication links and other electronic modules or assemblies. Various international and industry standards define the type of connectors used to connect computers to external communication devices, such as modems, network connectors, and other transceivers. A well-known type of transceiver module developed by an industry consortium and known as a Gigabit Connector Converter (GBIC) provides a connection between a computer and an Ethernet, Fiber Channel, or another data communication environment.

It is desirable to miniaturize transceivers in order to increase the port density at a network connection (at switch boxes, cabling patch panels, wiring closets, computer I/O, etc.). Small form-factor pluggable (SFP) transceiver modules were developed to meet this need, SFP transceivers are less than one half the size of a GBIC transceiver, and transmit data transmission at higher rates, allowing higher aggregated data throughput in a communication system.

Prior art SFP transceiver modules feature a connector having a plurality of electrical terminals accessible at a front end thereof for making electrical contact with a mating plug connector. Such electrical terminals are soldered to a front edge of a printed circuit board received in the transceiver module. However, the soldered connection between each terminal and the circuit board is relatively weak. When a mildly excessive force is exerted against the terminals, they break from the circuit board, and performance of the transceiver module is impaired.

Accordingly, there is a need for an SFP transceiver module having a reinforced structure that strengthens the connection between the connector at the front end of the SFP transceiver module and the rest of the transceiver module, thus protecting the terminals that extend from the front end of the SFP transceiver module.

SUMMARY OF THE INVENTION

An object of the present invention is to provide an RJ connector with a robust interface for fixingly engaging in an SFP transceiver module.

Another object of the present invention is to provide an SFP transceiver module for plugging into a shielding receptacle.

A small form factor pluggable transceiver module according to the present invention comprises an RJ connector with a robust interface, a printed circuit board assembly, a cage, a frame and a latch mechanism. The RJ connector further includes a shielding shell, a housing received in the shielding shell, an RJ contact module attached to the housing, and an engaging clamp. The RJ connector attaches to the printed circuit board assembly. The engaging clamp provides a stronger, more reliable mechanical connection between the printed circuit board assembly and the RJ connector.

Other objects, advantages and novel features of the present invention will be drawn from the following detailed description of two preferred embodiments of the present invention, with attached drawings, in which:

DETAILED DESCRIPTION OF THE PREFERRED EMBODIMENT

Figure 1:
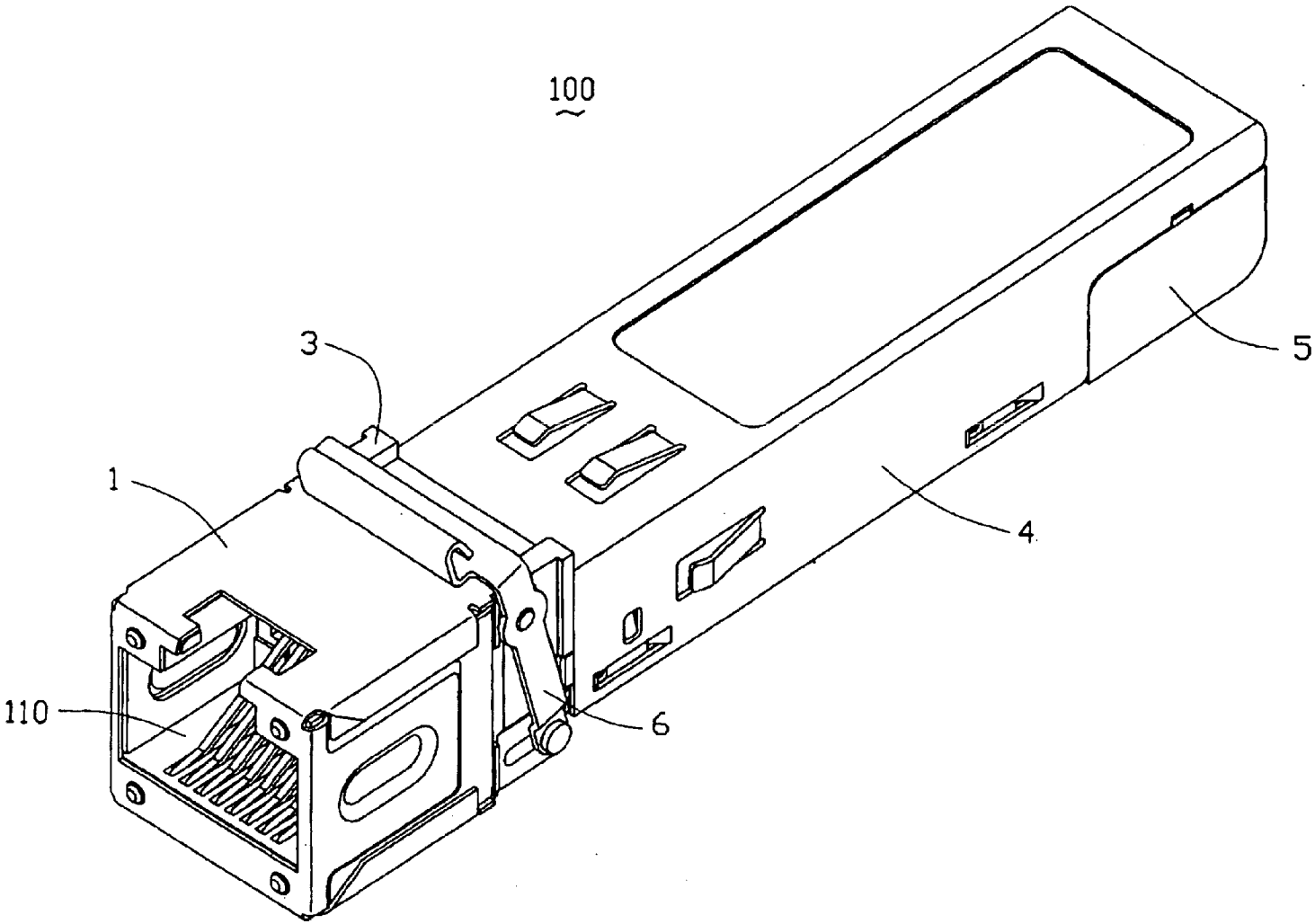
FIG. 1 is an assembled, perspective view of an SFP transceiver module of a first embodiment of the present invention.
Figure 2:
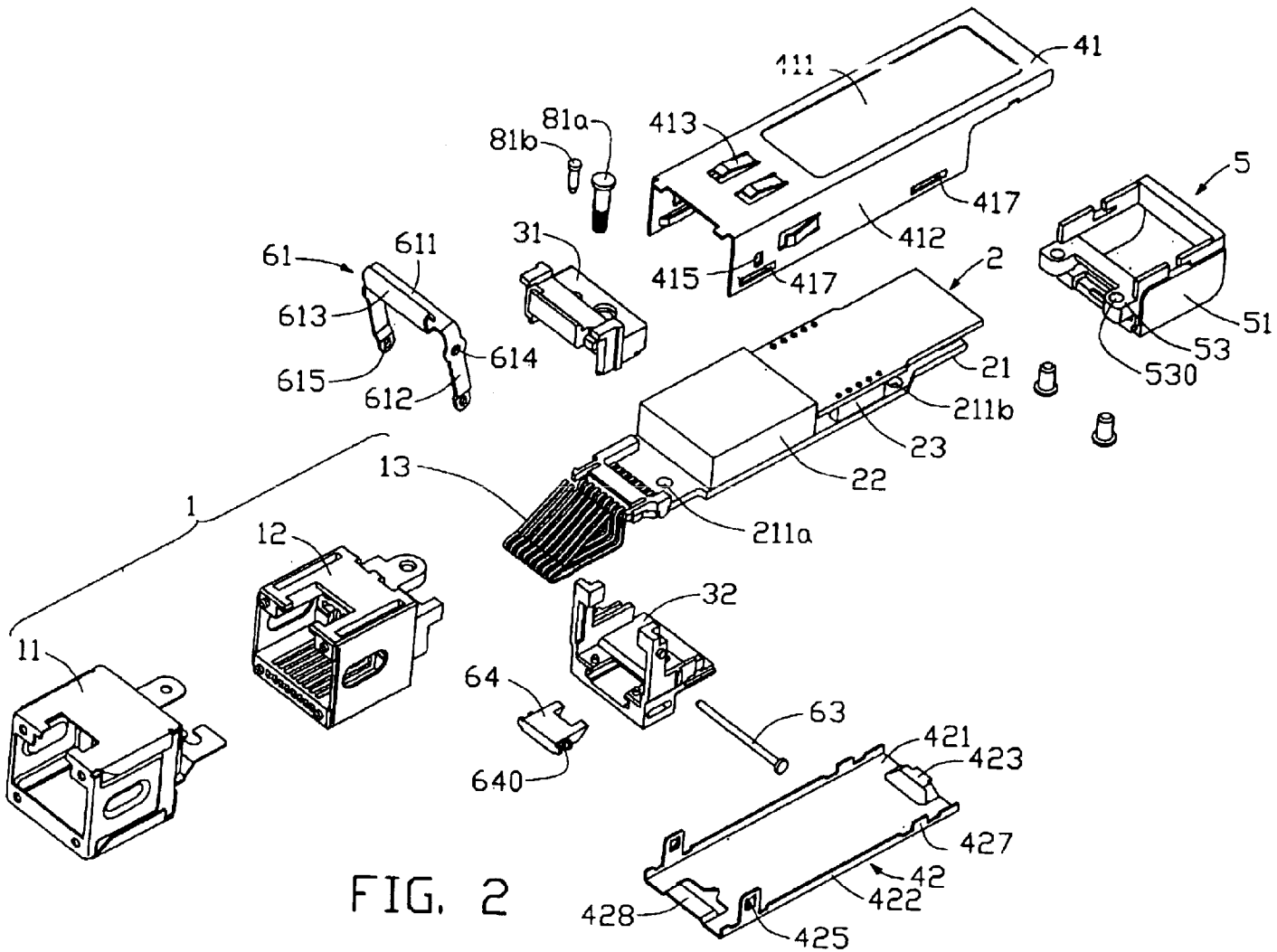
FIG. 2 is an exploded view of the SFP transceiver module of FIG. 1.

Referring to FIGS. 1 and 2, a small form factor pluggable (SFP) transceiver module 100 in accordance with the first embodiment of the present invention comprises an RJ connector 1 with a robust interface, a printed circuit board assembly (PCBA) 2, a cage 4, a frame 5 and a latch mechanism 6. The RJ connector 1 is attached to the PCBA 2, the cage 4 mounting the frame 5 receives the PCBA 2 therein, and the latch mechanism 6 is rotatably attached to the RJ connector 1 for disassembly of the SFP transceiver module 100 from a shielding receptacle 9 (see FIG. 7).

Figure 3:
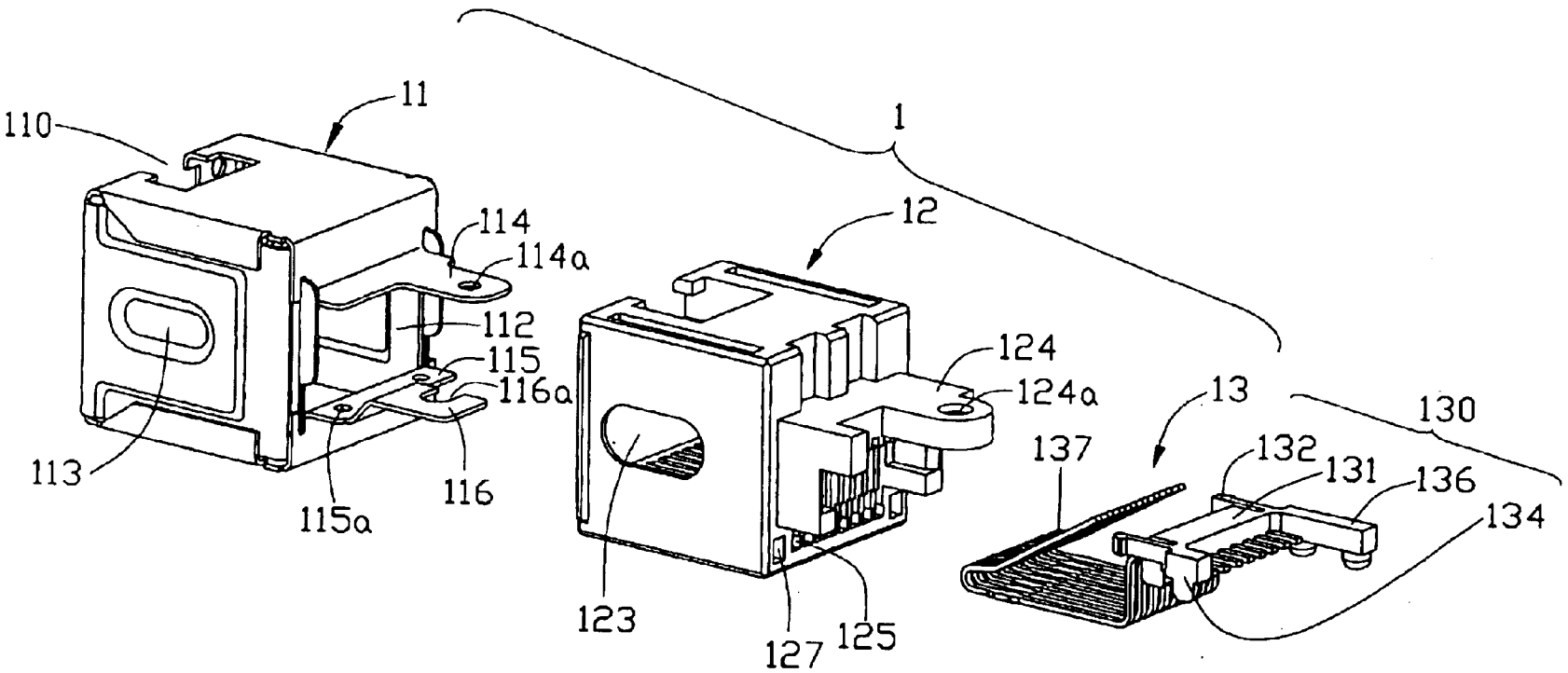
FIG. 3 is an exploded view of an RJ connector of the SFP transceiver module of FIG. 1.

Referring to FIG. 3, the RJ connector 1 comprises a shielding shell 11, a housing 12, an RJ contact module 13 and an engaging clamp 3. The shielding shell 11 is made from one piece of conductive material folded into a rectangular receptacle having first and second openings 110, 112. Two concave embossments 113 are respectively defined on two opposite walls of the shielding shell 11. A top sheet 114 projects rearwardly from a top edge of the second opening 112. A mounting hole 114*a* is defined through the top sheet 114. A bottom sheet 115 projects rearwardly from a bottom edge of the second opening 112, and defines a pair of mounting holes 115*a* therethrough. A protrusion 116 extends integrally from the bottom sheet 115 and defines a notch 116*a* therethrough.

The housing 12 is made of isolating material and is received within the shielding shell 11. A pair of slots 123 is defined at two sides (not labeled) of the housing 12 for engagingly receiving the concave embossments 113 of the shielding shell 11. A flange 124 projects rearwardly from the housing 12 and corresponds to the top sheet 114 of the shielding shell 11, a screw hole 124*a* being defined therethrough and corresponding to and aligning with the mounting hole 114*a* of the shielding shell 11. A plurality of parallel receiving channels 125 is defined through a bottom portion of a rear side (not labeled) of the housing 12. A pair of locking slots 127 is defined near the receiving channels 125.

The RJ contact module 13 includes a dielectric RJ module frame 130 and a plurality of conductive contacts 137. The RJ module frame 130 includes a rib 131, a pair of hooks 132, a short arm 134 and a long arm 136. The hooks 132 extend forwardly from two sides of the rib 131, for inserting into the locking slots 127 of the housing 12. The short arm 134 and the long arm 136 extend rearwardly and form a plurality of positioning rods (not labeled) for being pressed into mounting holes (not shown) in the PCBA 2 to engage the PCBA 2 with the RJ contact module 13. The contacts 137 are insert molded with the rib 131. A short portion (not labeled) of each contact 137 extends rearwardly from the rib 131 for soldering to the PCBA 2, and a bent long portion (not labeled) extends forwardly for being received in the housing 12 to electrically contact terminals of a complementary connector (not shown) plugged into the first opening 110 of the RJ connector 1.

Referring back to FIG. 2, the PCBA 2 includes a main board 21, with a magnetic module 23 and a power module 22 mounted thereto. A mounting hole 211*a* is defined through a front end of the main board 21 and two mounting holes 211*b* are defined through a rearward end of the main board 21.

To assemble the RJ connector 1 to the PCBA 2, the housing 12 is received within the shielding shell 11 and the RJ contact module 13 is attached to the main board 21 on the PCBA 2. The plurality of positioning rods (not labeled) on the short and long arms 134, 136 of the frame 130 are pressed into corresponding mounting holes (not shown) in the main board 21. The short portions of the contacts 137 are soldered to the main board 21 and electrically connect with circuits of the PCBA 2. The long portions of the contacts 137 are then inserted into the channels 125 of the housing 12, and the hooks 132 of the RJ contact module 13 are inserted into the locking slots 127 of the housing 12. Completion of assembly of the shielding shell 11 and housing 12 mounted to the main board 21 of the PCBA 2 requires use of the engaging clamp 3.

Figure 4:
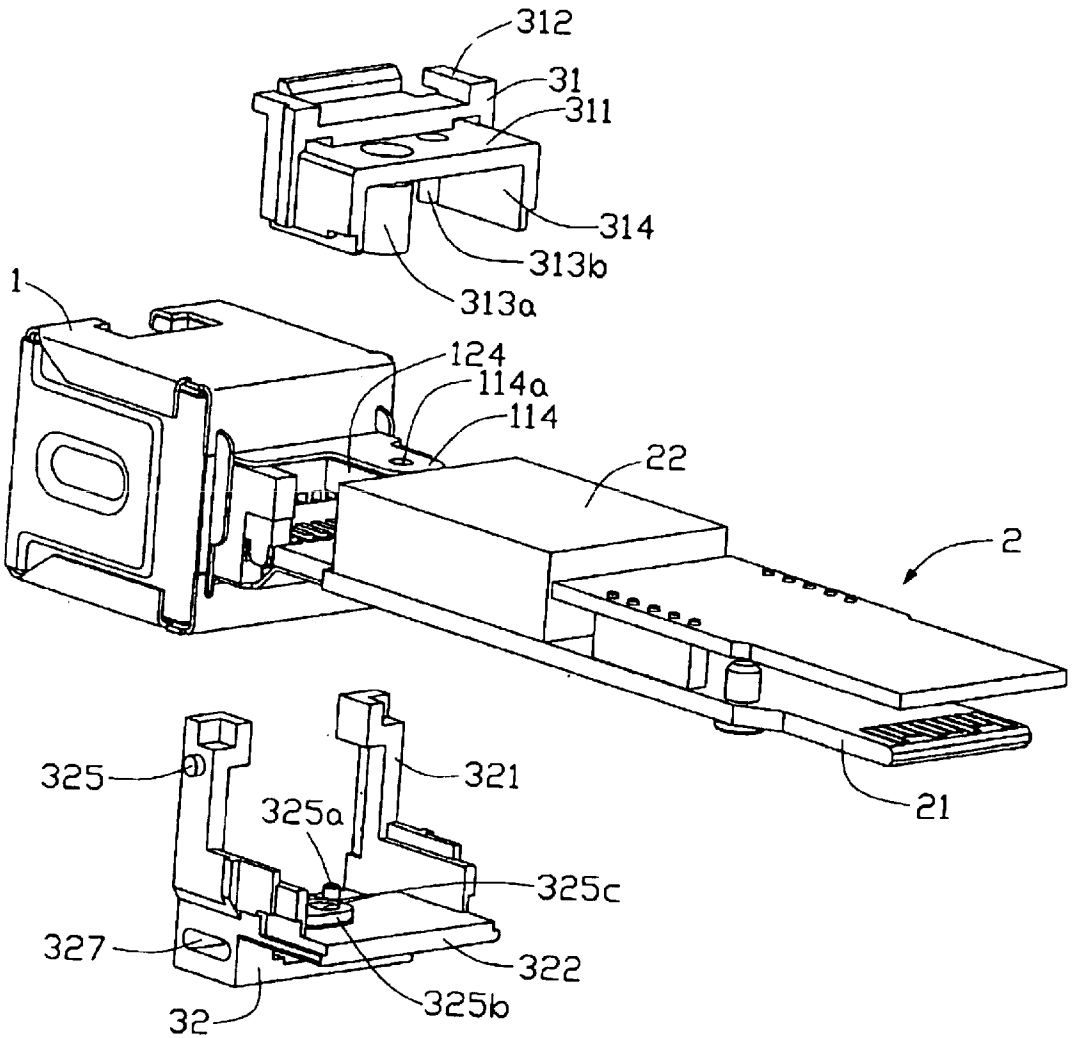
FIG. 4 is a perspective view of the RJ connector of FIG. 3 assembled to a printed circuit board assembly, and showing a top and a base clamp of the SFP transceiver module of FIG. 1 ready to be attached to the assembled RJ connector and printed circuit board assembly.

Referring also to FIG. 4, the engaging clamp 3 is die-cast and includes a top clamp 31 and a base clamp 32. The top clamp 31 includes a body 311, a pair of engaging portions 312 extending forwardly therefrom, a pair of side walls 314 extending downwardly from the body 311, and a screw rod 313*a* and a positioning rod 313*b* respectively extending from a bottom surface of the body 311. The base clamp 32 includes a pair of supporting arms 321 and a base 322. Each supporting arm 321 has an engaging face (not labeled) defined on a top end thereof for engaging with a corresponding engaging portion 312 of the top clamp 31. An axle 325 is formed on each supporting arm 321 adjacent to the top end thereof. A slot 327 is defined transversely through the body 322, and a passageway 329 (see FIG. 5) is defined longitudinally through the body 322 and in communication with the slot 327. A triangular wedge 328 (see FIG. 5) protrudes downwardly from a bottom surface of the base 322. Two mounting pins 325*a* are defined in the body 322 for engaging with the mounting holes 115*a* of the bottom sheet 115 of the shielding shell 11. A boss 325*b* is formed on the body 322. The boss 325*b* defines a screw hole 325*c* therethrough, which aligns with the screw rod 313*a* of the top clamp 31, the mounting hole 211*a* of the main board 21, and the notch 116*a* of the bottom sheet 115 of the shielding shell 11.

To assemble the engaging clamp 3 to the assembled RJ connector 1 and PCBA 2, the base clamp 32 is fitted against a bottom of the assembled RJ connector 1 and PCBA 2, with the boss 325*b* of the base clamp 32 fitting into the notch 116*a* of the shielding shell 11. The mounting pins 325*a* also fit into the mounting holes 115*a* of the bottom sheet 115. The top clamp 31 is then engaged with the base clamp 32, with the engaging portions 312 engaging with engaging faces (not labeled) of the supporting arms 321, and the screw pole 313*a* aligning with the mounting hole 211*a* of the PCBA 2 and the screw hole 325*c* in the boss 325*b* of the base clamp 32. The positioning rod 313*b* likewise inserts through the mounting hole 114*a* and the screw hole 124*a* of the RJ connector 1. A screw 81*a* (see FIG. 2) screws through the screw rod 313*a*, the mounting hole 211*a*, the notch 116*a* of the protrusion 116 and the screw hole 325*c* in the boss 325*b*. A locking pin 81*b* likewise is forcedly pushed through the positioning rod 313*b*. The engaging clamp 3 thus reinforces the connection between the RJ connector 1 and the PCBA 2. The strength of the RJ connector 1 is thereby increased.

Figure 5:
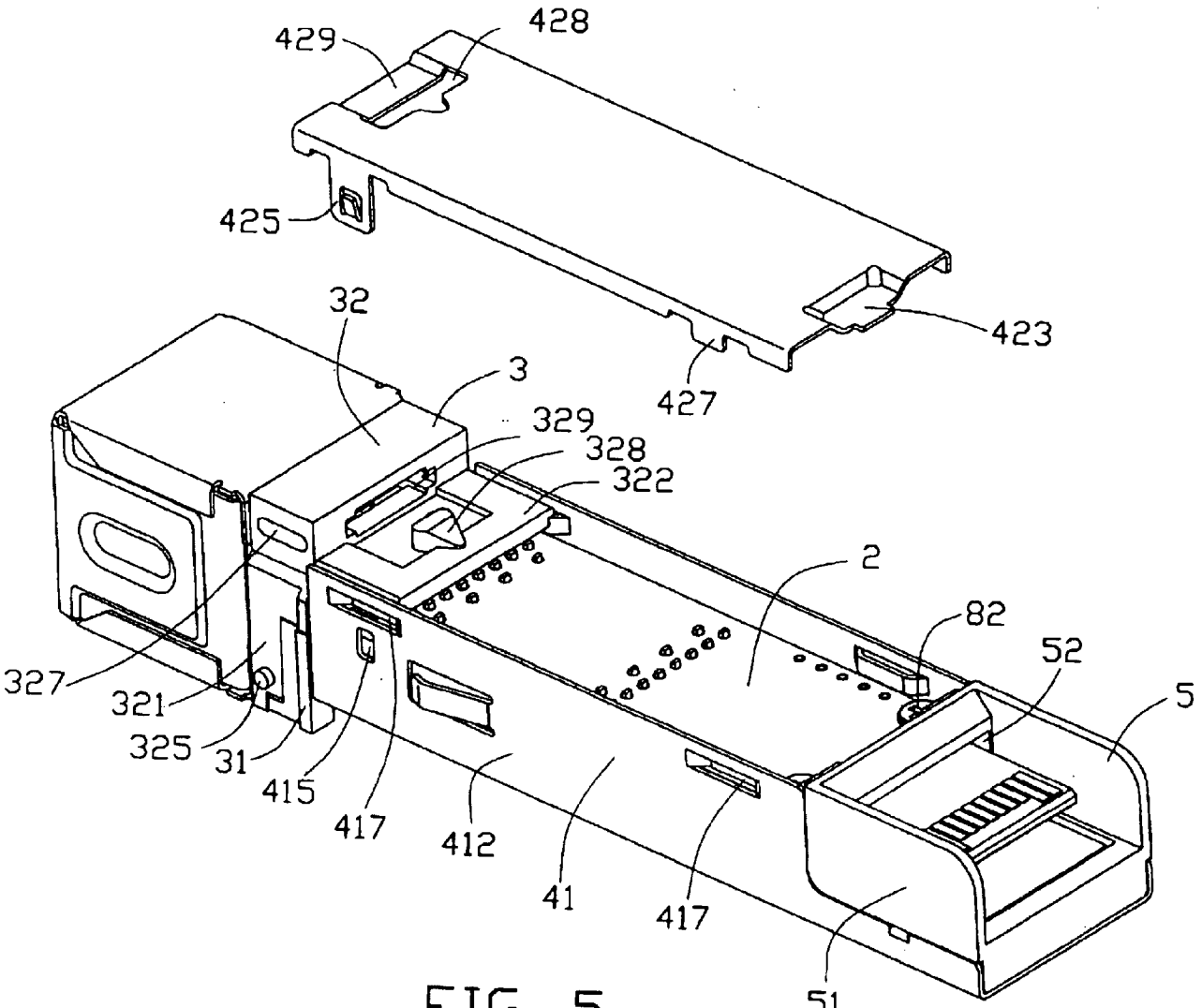
FIG. 5 is a reverse view of FIG. 1, wherein a bottom cage is not assembled thereto.

Referring to FIGS. 2 and 5, the cage 4 for receiving the PCBA 2 is made of conductive material, and includes separate top and bottom cages 41, 42. The top cage 41 includes an elongate, rectangular top wall 411 and two side walls 412 extending downwardly therefrom. A length of the side wall 412 is shorter than the top wall 411. A plurality of grounding tabs 413 extends outwardly from a first end (not labeled) of the top wall 411 and two side walls 412. A cut-out 415 is defined at a front of each of the side walls 412. A receiving slit 417 is respectively defined at each of a front and a rear end of each of the sidewalls 412.

The bottom cage 42, also made of a conductive material, includes an elongate, rectangular bottom wall 421 and a pair of short side walls 422 extending upwardly therefrom. A triangular opening 428 is defined through a front of the bottom cage 42, and a curved surface 429 is formed forwardly of the opening 428. A groove 423 is formed at a rear end of the bottom cage 42, with a tab (not labeled) projecting rearwardly therefrom. A pair of locking tabs 425 and a pair of short tabs 427 respectively extend vertically upwardly from the short side walls 422 to engage the cut-outs 415 and the receiving slits 417 of the top cage 41.

The frame 5 for attaching to the top cage 41 is die-cast of a conductive material, and has two side walls 51, an opening 52 and a pair of positioning blocks 53. Two screw holes 530 are respectively defined through the positioning blocks 53, for aligning with the mounting holes 211*b* of the main board 21 of the PCBA 2.

To assemble the cage 4 to the assembled PCBA 2, the frame 5 is attached to the rear end of the top cage 41 and the PCBA 2 is inserted into the top cage 41 from the front end thereof, with its rear end being received in the frame 5 from the opening 52 thereof. Two tabs (not labeled) on a front edge of the top wall 411 of the top cage 41 respectively engage in two slits (not labeled, see FIG. 4) in the top clamp 31. Two screws 82 are inserted into the mounting holes 211*b* of the main board 21 and the screw holes 530 of the frame 5 to fix the PCBA 2, the frame 5 and the top cage 41 together. The bottom cage 42 is assembled to cover a bottom of the top cage 41. The triangular wedge 328 of the base clamp 32 passes through the opening 428 of bottom cage 42, and the tab (not labeled) of the groove 423 is retained by the frame 5. The locking tabs 425 lockingly engage the forward slits 417 and the cut-outs 415 of the top cage 41, and the short tabs 427 are received into the rearward slits 417. The top cage 41 and the bottom cage 42 are thus engaged together and receive the engaging clamp 3 and the PCBA 2 therein.

Figure 6:
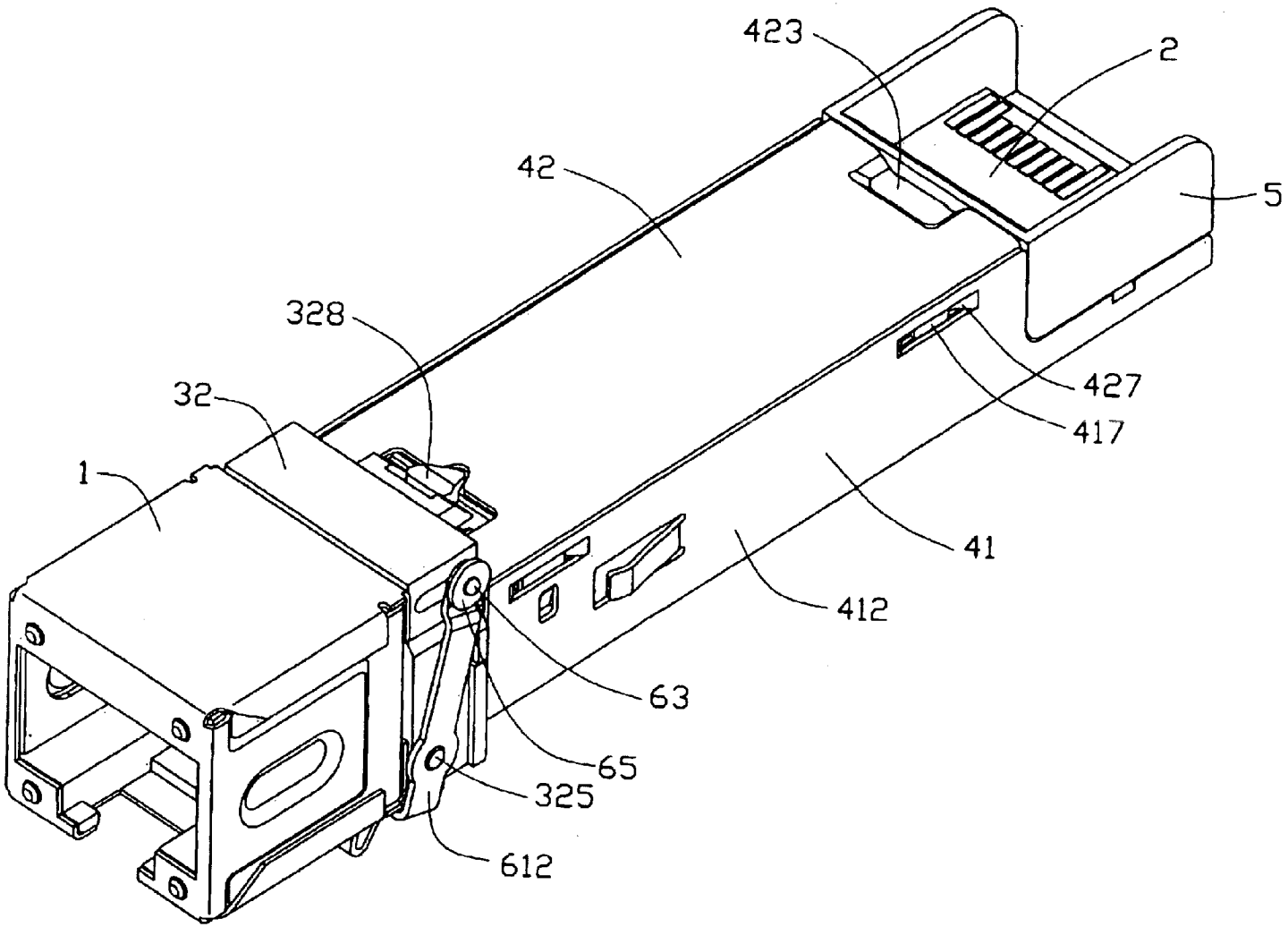
FIG. 6 is an assembled, perspective view of at he SFP transceiver module of FIG. 1, but viewed from a bottom aspect.

Referring to FIGS. 2 and 6, the latching mechanism 6 includes an actuator 61, a linkage pin 63, an extraction tab 64 and an O-ring 65. The actuator 61 is shaped like a doorframe, and includes a doorhead 611 and two doorjambs 612. A handle 613 curves upwardly and rearwardly from the doorhead 611. A pair of positioning holes 614 is defined through the doorjambs 612 for engagingly receiving the axles 325 of the base clamp 32, and a pair of mounting holes 615 is defined through the bottom ends thereof for engagingly receiving the linkage pin 63. The linkage pin 63 is a rod having a head (not labeled) on one end that is larger than the mounting hole 615 of the doorjamb 612. A through hole 640 is defined through the extraction tab 64 for receiving the linkage pin 63 therein.

To assemble the latching mechanism 6 to the engaging clamp 3, the extraction tab 64 is inserted into the passageway 329 of the base clamp 32, and the actuator 61 is attached to the base clamp 32 with the mounting holes 614 engagingly receiving the axles 325. The linkage pin 63 passes through the mounting holes 615, the slots 413, 327, and the through hole 640 of the extraction tab 64. The O-ring 65 is then attached to an end of the linkage pin 63 opposite the head, to prevent the linkage pin 63 from moving out of engagement with the latching mechanism 6. The assembly of the SFP transceiver module 100 is thus finished.

In operation, pulling the handle 613 of the actuator 61 forwardly, causes the actuator 61 to rotate about the axles 325. The rotating movement drives the linkage pin 63 and extraction tab 64 rearwardly. The extraction tab 64 moves rearwardly along the curved surface 429, and the triangular wedge 328 of the base clamp 32, drives against the lip 92 of the locking tab 90 on the shielding receptacle 9. As a result, the locking tab 90 is driven downwardly, the triangular wedge 328 is released from the triangular hole 91, and the SFP transceiver module 100 is disengaged from the shielding receptacle 9.

Figure 7:
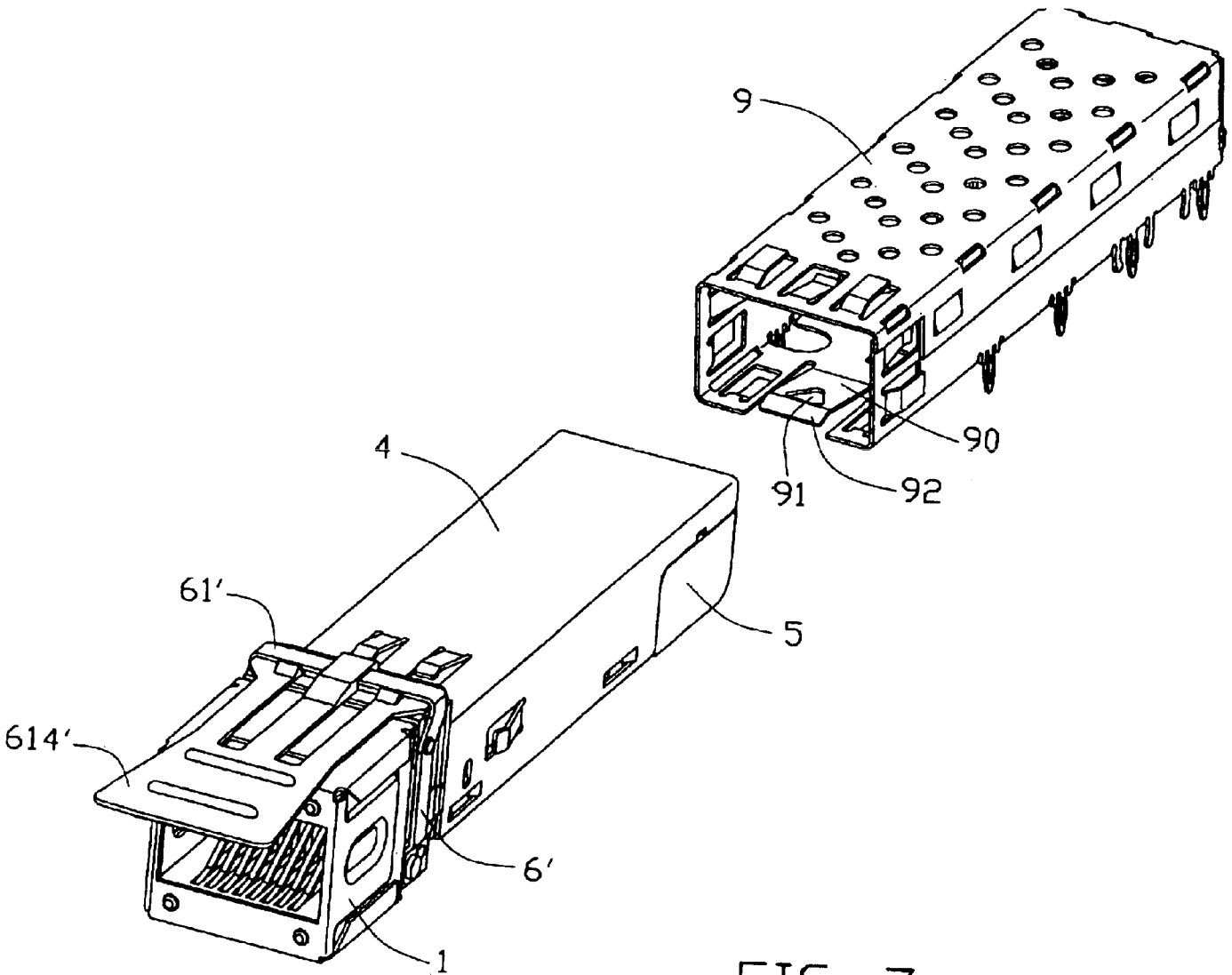
FIG. 7 is an assembled, perspective view of an SFP transceiver module of a second embodiment of the present invention, and a shielding receptacle adapted for receiving the SFP transceiver module therein.

Referring also to FIG. 7, a second embodiment of the latching mechanism 6' replaces the actuator 61' with an actuator 61' and a pull-tab 614' linked to the actuator 61". In operation, the pull-tab 614" is pulled forwardly away from the front of the SFP transceiver module 100, thereby pulling a top of the actuator 61' forwardly and causing the actuator 61' to rotate about the axles 325. This design makes the operation of the actuator 61' easy.

Although the present invention has been described with specific terms, it should be noted that the described embodiments are not necessarily exclusive, and that various changes and modifications may be made thereto without departing from the scope of the present invention as defined in the appended claims.

What is claimed is:

1. An RJ connector having a robust interface for connecting to a printed circuit board in a small form factor pluggable transceiver module, comprising:

a shielding shell including a top sheet and a bottom sheet;

a housing being received in the shielding shell, the housing including a flange projecting therefrom;

an RJ contact module for electrically connecting with the printed circuit board, conductive contacts of the RJ contact module being received in the housing;

a top clamp; and a base clamp coupling with the top clamp;

wherein the top clamp, the shielding shell, the housing and the base clamp are engaged together, the top sheet engages with the flange of the housing and with the top clam and the bottom sheet engages with the base clamp, and the conductive contacts are secured among the top clamp, the shielding shell, the housing and the base clamp.

2. The RJ connector having a robust interface as described in claim 1, wherein the shielding shell is made of a conductive material.

3. The RJ connector having a robust interface as described in claim 1, wherein the housing is made of insulating material.

4. The RJ connector having a robust interface as described in claim 1, wherein a plurality of receiving channels is defined through the housing to receive the conductive contacts therethrough.

5. The RJ connector having a robust interface as described in claim 1, wherein the housing defines a plurality of channels and a pair of slots therein.

6. The RJ connector having a robust interface as described in claim 5, wherein the RJ contact module includes a plurality of conductive contacts and an RJ module frame, the frame includes a rib, and the conductive contacts are held within the rib.

7. The RJ connector having a robust interface as described in claim 6, wherein a pair of hooks extends from the rib, the hooks are insertable into the slots of the housing for preventing the RJ contact module from releasing from the housing, and the conductive contacts are received in the channels.

8. A small form factor pluggable transceiver module for being plugged into a shielding receptacle, comprising:

a printed circuit board assembly;

an RJ connector assembly connecting with the printed circuit board assembly, the RJ connector assembly having an RJ connector and an engaging clamp; and a latch mechanism rotatably attaching to the RJ connector assembly for disassembling the small form factor pluggable transceiver module from the shielding receptacle;

wherein the RJ connector assembly is fixedly screwly engaged with the printed circuit board assembly, and a plurality of conductive contacts retained in the RJ connector assembly are reliably connected to the printed circuit board assembly.

9. The small form factor pluggable transceiver module as described in claim 8, wherein the printed circuit board assembly includes a main board with a magnetic module and a power module.

10. The small form factor pluggable transceiver module as described in claim 8, wherein the RJ connector assembly further includes a shielding shell, a housing received in the shielding shell, and an RJ contact module.

11. The small form factor pluggable transceiver module as described in claim 10, wherein the conductive contacts are integrally formed in the RJ contact module, and a portion of each conductive contact is received in the housing and another portion is soldered to the printed circuit board assembly.

12. The small form factor pluggable transceiver module as described in claim 10, wherein the housing includes a flange and the shielding shell includes a top sheet and a bottom sheet.

13. The small form factor pluggable transceiver module as described in claim 12, wherein the engaging clamp includes a top clamp and a base clamp, the top clamp engages with the top sheet of the shielding shell and the flange of the housing, and the base clamp screwly engages with the bottom sheet of the housing and the printed circuit board assembly.

14. The small form factor pluggable transceiver module as described in claim 8, further comprising a cage receiving the printed circuit board assembly wherein the cage includes a top cage and a bottom cage.

15. The small form factor pluggable transceiver module as described in claim 14, further including a frame attaching to a rear portion of the top cage to receive the printed circuit board assembly therein.

16. The small form factor pluggable transceiver module as described in claim 8, wherein the latch mechanism includes a linkage pin, an extraction tab and an actuator.

17. The small form factor pluggable transceiver module as described in claim 16, wherein a pull-tab is attached to the actuator of the latch mechanism.

18. An electrical module comprising:

a horizontal printed circuit board;

a metallic cage enclosing said printed circuit board;

a connector located in front of the printed circuit board and including an insulative housing enclosed in a metallic shell;

a plurality of terminals located in the housing, and mechanically and electrically connected to the printed circuit board; and a clamp device being discrete from and located right behind the connector and in front of the printed circuit board, said clamp device attached to at least one of said shell and said housing, wherein said clamp device is equipped with a latch mechanism including an extraction tab moveable along a front-to-back direction and actuated to move by a pivotal actuator.

19. The module as described in claim 18, wherein said clamp device is attached to said at least one of said shell and said housing in a direction perpendicular to said printed circuit board.

20. An RJ connector having a robust interface for connecting to a printed circuit board in a small form factor pluggable transceiver module, comprising:

a shielding;

a housing being received in the shielding shell, and defining a plurality of channels and a pair of slots therein;

an RJ contact module for electrically connecting with the printed circuit board, the RJ contact module being received in the housing, and including a plurality of conductive contacts and an RJ module frame, the frame including a rib, and the conductive contacts being held within the rib and received in the housing;

a top clamp; and a base clamp coupling with the top clamp;

wherein the top clamp, the shielding shell, the housing and the base clamp are engaged together and the conductive contacts are secured therebetween.

21. The RJ connector having a robust interface as described in claim 20, wherein a pair of hooks extends from the rib, the hooks are insertable into the slots of the housing for preventing the RJ contact module from releasing from the housing, and the conductive contacts are received in the channels.

* * * * *